US006111502A

United States Patent [19]

Lenglart et al.

[11] Patent Number: 6,111,502

[45] Date of Patent: Aug. 29, 2000

[54] METHOD AND DEVICE FOR KEEPING WATCH OVER PREMISES BY HAVING DIFFERING ACTIVATION TIMES OF SENSORS

[75] Inventors: Pascal Lenglart, Gif sur Yvette; Bruno Vo Qui, Paris, both of France

[73] Assignee: Alcea, Courtaboeuf Cedex, France

[21] Appl. No.: 09/381,340

[22] PCT Filed: Nov. 2, 1999

[86] PCT No.: PCT/FR98/00541

§ 371 Date: Sep. 20, 1999

§ 102(e) Date: Sep. 20, 1999

[87] PCT Pub. No.: WO98/41954

PCT Pub. Date: Sep. 24, 1998

[30] Foreign Application Priority Data

Mar. 19, 1997 [FR] France ..... 97 03362

[51] Int. Cl.[7] ..... G08B 13/00

[52] U.S. Cl. ..... 340/541; 340/517; 340/825.31; 340/825.34; 340/527

[58] Field of Search ..... 340/541, 517, 340/521, 522, 523, 524, 527, 528, 529, 530, 825.31, 825.32, 825.34, 147; 379/103

[56] References Cited

U.S. PATENT DOCUMENTS

| | | | |
|---|---|---|---|
| 3,787,832 | 1/1974 | Bolinger | 340/276 |
| 4,023,139 | 5/1977 | Samburg | 340/147 |
| 4,327,353 | 4/1982 | Beard et al. | 340/64 |
| 4,367,458 | 1/1983 | Hackett | 340/539 |
| 4,540,977 | 9/1985 | Taillens et al. | 340/552 |
| 4,644,104 | 2/1987 | Middlemiss | 379/103 |
| 4,689,610 | 8/1987 | Dietrich | 340/515 |
| 4,755,792 | 7/1988 | Pezzolo et al. | 340/538 |
| 5,003,290 | 3/1991 | Lindquist et al. | 340/545 |
| 5,019,802 | 5/1991 | Brittain et al. | 340/522 |
| 5,057,817 | 10/1991 | Berube | 340/506 |
| 5,083,106 | 1/1992 | Kostusiak et al. | 340/506 |
| 5,325,084 | 6/1994 | Timm et al. | 340/541 |
| 5,631,630 | 5/1997 | McSweeney | 340/522 |

FOREIGN PATENT DOCUMENTS

| | | |
|---|---|---|
| 2 271 455 | 4/1994 | United Kingdom . |
| WO91/20026 | 12/1991 | WIPO . |
| WO96/19783 | 6/1996 | WIPO . |

*Primary Examiner*—Jeffery A. Hofsass
*Assistant Examiner*—Phung Nguyen
*Attorney, Agent, or Firm*—Young & Thompson

[57] ABSTRACT

The invention concerns a system for keeping watch over premises, comprising: elements (LA–LD) for controlling access to these premises; elements (V1–V3, P1–P8) for detecting intrusion or unauthorized presence in these premises, including perimeter detection elements (P1–P8) for detecting any intrusion in a predetermined perimeter around these premises, volumetric detection elements (V1–V3) for detecting any presence in predetermined zones of these premises. The access controlling elements (LA–LE) and the intrusion detecting elements (V1–V3, P1–P8) co-operate to put off the activation of some volumetric detection elements (V1–V3) for a predetermined exception delay whenever the access controlling elements (LA–LE) validate, during watch time, the presence of an authorized person or an access request from same. The invention is applicable to the watch and security of small buildings and professional and administrative offices.

15 Claims, 2 Drawing Sheets

METHOD AND DEVICE FOR KEEPING WATCH OVER PREMISES BY HAVING DIFFERING ACTIVATION TIMES OF SENSORS

DESCRIPTION

The present invention relates to a system for surveillance of premises. It also envisages a method employed in this system.

From now on premises are understood to mean any bounded space taking the form of a building, real estate, individual or multi-occupancy housing, and more generally any premises for industrial, commercial, social, administrative or private purposes.

In what follows, the action of badging means that a person submits his personal badge, in practice a card provided with personal identification means, to be read by a badge reader, either in order to obtain access or in response to a call from this reader.

Effective surveillance of premises covers two essential aspects: on the one hand, control of access to these premises, and on the other hand dealing with alarms in the event of intrusion or unauthorised presence in these premises.

Present-day access control systems employ equipment for reading badges or cards, a processing and control centre and access-control devices.

Present-day alarm systems employ intrusion detectors, a control and processing centre, alarm devices and remote transmission equipment. These alarm systems generally employ two levels of security:

perimeter monitoring, that is to say all the door or window contacts protecting the external accesses of the perimeter of the building, volumetric monitoring, that is to say all the infra-red or UHF radars securing the interior of the premises.

Many business premises already have a system for control of access and an alarm system available. In the majority of cases, and in particular in small buildings, these systems are not coupled or even connected, and those responsible for these systems have to carry out parameter setting and programming of these two systems separately. This entails significant risks of malfunctioning between the two systems entailing, on the one hand, inconvenience for the users of the premises in question and, on the other hand, risks of jeopardising the surveillance of these premises. This inconvenience and these risks may occur principally in extreme situations such as at the start and end of a period of inhibition of the alarm, on non-working days and the day before a holiday period.

The document U.S. Pat. No. 4,689,610 discloses a system for security and access control for protecting a set of protection areas, comprising access-control equipment, equipment for detecting intrusion or unauthorised presence in the protected regions, and provided with a programming timetable defining working periods and surveillance periods corresponding to the intrusion-detection equipment being put into service. This system allows postponement of the activation of volume-detection equipment by a predetermined derogation period whenever the access-control equipment, during the surveillance periods, validates a presence of, or a request for access from, an authorised person provided with personal identification means.

The document U.S. Pat. No. 4,327,353 discloses a security system employed particularly for surveillance of vehicles or premises, using a coded electronic key, and a decoder configured to receive this electronic key. This system is de-activated with the key itself and activation postponements are provided to allow movements within a security-protected area.

The document U.S. Pat. No. 5,057,817 discloses a multi-area intrusion detection system comprising a supervision circuit configured to verify, on the basis of normal activity or traffic in each of the protection areas, although the system is disarmed, that each intrusion detector is actually in working order.

The object of the invention is to remedy the abovementioned drawbacks by proposing a system for surveillance of premises which guarantees perfect coherence and synergy between the two alarm and access-control functions, without in any way requiring expensive control and processing installations which should be reserved for surveillance of large buildings, for obvious reasons of economy.

This objective is achieved with a system for surveillance of premises, comprising:

means for controlling access to these premises, comprising personal identification means, means for reading these personal identification means and means for processing and granting requests for access to the premises, means for detecting any intrusion or unauthorised presence in the said premises, comprising perimeter detection means for detecting any intrusion into a defined perimeter around the said premises, volumetric detection means for detecting any presence in predetermined areas of the said premises, and this system further including a programming timetable defining working periods and surveillance periods corresponding to the intrusion detection means being put into service.

According to the invention, the access-control means and the intrusion-detection means co-operate to postpone the activation of volumetric detection means by a predetermined derogation period whenever the said access-control means, during periods when surveillance is in force, validate the presence of, or a request for access from, an authorised person.

Hence a system for surveillance of premises is available which requires neither counting nor down-counting of accesses. Moreover, it combines the advantages of control of access: time-based and geographical management of accesses, a priori no further requirement to distribute keys and the fact that there is no longer any risk of forgetting to put the alarm into or out of service.

During periods of surveillance, perimeter detection means are preferably kept activated even during the postponement of activation of the volumetric detection means.

It may moreover be particularly advantageous for the activation postponement also to relate to certain perimeter detection means, so as, for example, to allow a person who wishes to work during a period of surveillance to be able to open his window.

Conversely, provision may be made for certain parts of the premises under surveillance to be kept under volumetric surveillance even during derogation periods, in the case, for example, of rooms containing sensitive documents or equipment, access to which is authorised only in working hours.

Provision may moreover advantageously be made for the access-control means and the intrusion-detection means to co-operate so as, in working hours, not to de-activate the volumetric detection means and the perimeter detection means for the rest of the working period, until after validation of a first request for access by an authorised person.

The surveillance system according to the invention further comprises means for inviting any person present in the premises during the periods of surveillance to validate his presence in the said premises. These invitation means may be of any type, for example audible warning devices such as buzzers or pre-recorded or digitised voice messages and/or visual warning devices such as lamps, flashing lights or graphics messages.

Provision may moreover advantageously be made for the access-control reading means to be configured to receive a validation of presence by a person in response to a call by the invitation means.

However, the telephone instruments may also constitute invitation means by their ringing tone and means for receiving a validation of presence by a person in response to a call. It suffices for the central means of the system to be connected to the internal telephone network of the premises under surveillance.

The surveillance system according to the invention may further include specific means for receiving a validation of presence by a person in response to call by the invitation means. These specific means may for example be badge readers dedicated to the presence-validation function or equally other validation equipment.

The surveillance system according to the invention further comprises central surveillance means connected to the intrusion-detection means and to the access-control means and comprising means for setting the parameters of said intrusion-detection means and access-control means.

In one preferred embodiment, these central means comprise a database containing access rights and time-based management parameters.

According to another aspect of the invention, a method for surveillance of premises is proposed, implemented in a system according to the invention, characterised in that it comprises, at an instant defined as being the end of a working period, a stage of activation of the perimeter detection means, and a stage for inviting any person present in the premises to have his presence validated, this invitation stage being followed: (i) in the event of non-validation of presence, by activation of the volumetric detection means, (ii) in the event of a validation of presence, by a postponement of activation of the volumetric detection means by a predetermined derogation period.

The method further comprises, for each working period, a stage of de-activation of the perimeter detection means and of the volumetric detection means for the rest of the working period, this de-activation stage being carried out only after the first validation of a request for access by an authorised person.

It further comprises, in a working period or during a sequence of suspension of a surveillance period, a stage for immediately activating the intrusion-detection means in response to an immediate activation command. Moreover, the invitation stage comprises the activation of a buzzer of any other warning means for a predetermined invitation duration.

With the surveillance system according to the invention, securing of a building is carried out upon programming without a time schedule, without a key or code, and the volumetric surveillance is operational only when there is no longer anyone present in the premises to be protected. At no time is the building without protection. This is because, in the event of authorised access in a period of surveillance, monitoring of the perimeter remains active although volumetric protection is de-activated thus allowing free internal movement. Re-entry into service is ensured automatically after the departure of the person.

Moreover, it offers the possibility of an identification, in a daily log, of the persons having postponed entry into service or cut off the alarm. Moreover, a person may be immediately denied access, and thus made unable to remain alone during the evening or to inhibit surveillance over the weekend or overnight.

Other functions may be envisaged with a surveillance system according to the invention. Hence, at any instant, an immediate cycle of entry into service, perimeter or volumetric, can be initiated.

Validation can be achieved by any method other than the action of badging. For example, provision may be made for the central unit of the surveillance system according to the invention to be connected to the building telephone exchange. Thus, by dialling an internal number, persons signal their presence to the system.

Moreover, the surveillance system according to the invention may furthermore undertake domestic automation functions based on the occupied or unoccupied state of the building, particularly relating to the management of the heating, air-conditioning or other functionality within the building.

In one preferred embodiment, a database contains the badges, sets of rights for controlling the badge readers, a set of hierarchically-structured passwords and time schedules with free access periods.

It is advantageous, moreover, to keep a log of a predetermined number of most recent accesses or time-stamped events such as a door forced, an open time exceeded, a user connection, an alteration to the database or self-protection of the cabinet containing the central unit.

Setting the parameters of the surveillance system according to the invention can be carried out from a Minitel or microcomputer linked to the central unit of the system.

Other features and advantages of the invention will emerge further from the description below. In the attached drawings, given by way of non-limiting examples:

An exemplary embodiment of a surveillance system according to the invention will now be described by reference to the abovementioned figures.

The system 1 for surveillance of premises 10 comprises:

- a central surveillance unit CS connected to a printer IM and to a microcomputer or Minitel TO,
- an intrusion-detection subsystem, including volumetric detection equipment V1–V3, of infra-red or UHF type, arranged within the premises at appropriate sites, and of perimeter detection equipment P1–P8 arranged all around the premises 10 in the region of the doors and windows,
- an access-control subsystem comprising equipment for control of access to a main door PA especially provided with an external badge reader LA and with an exit push button BP, and with internal badge readers LB–LD for control of access to certain rooms, and specific equipment for implementing the invention such as a buzzer BZ inviting the persons present, during the surveillance period, to validate their presence, a specific badge reader LV provided to receive the validations of presence. Each badge reader may also be provided with a buzzer.

Internal telephone instruments PT1, PT2 may also be used in order, by activating their ringing tone, to invite the persons present in the premises to validate their presence and to receive validation information, for example a code entered on a key pad.

The access-control functions carried out by the surveillance system 1 according to the invention are:

management of a set of presence-validation or access-control readers LA–LD, LV;

management of the date of validity of the badges held by the authorised persons;

activation of a buzzer on the readers LA–LD, LV or of the special buzzer BZ in the event of the door PA not being closed within the expected interval;

time-based control of the exit push button BP;

possible releasing of the reader-controlled doors outside periods of surveillance.

The anti-intrusion functions carried out by the surveillance system according to the invention are as follows:

possible immediate securing of the premises;

control of a transmitter;

making available an alarm contact;

memory storage of the alarms on lights and in a log accessible from the microcomputer or the Minitel TO;

a self-protection input.

Other optional functions may be envisaged, such as:

automatic changeover between summer and winter time;

making available a presence contact allowing control of the lighting, air-conditioning or heating of the premises; or an input for validation by a no-volts contact, particularly for validating presence by push button or internal telephone.

The central surveillance unit CS at the heart of the surveillance system 1 according to the invention groups together all the control and processing means, preferably onto a single independent electronic card driven either locally by a microcomputer or by a Minitel TO, or remotely, for example over the telephone network via a modem.

Figure 1:
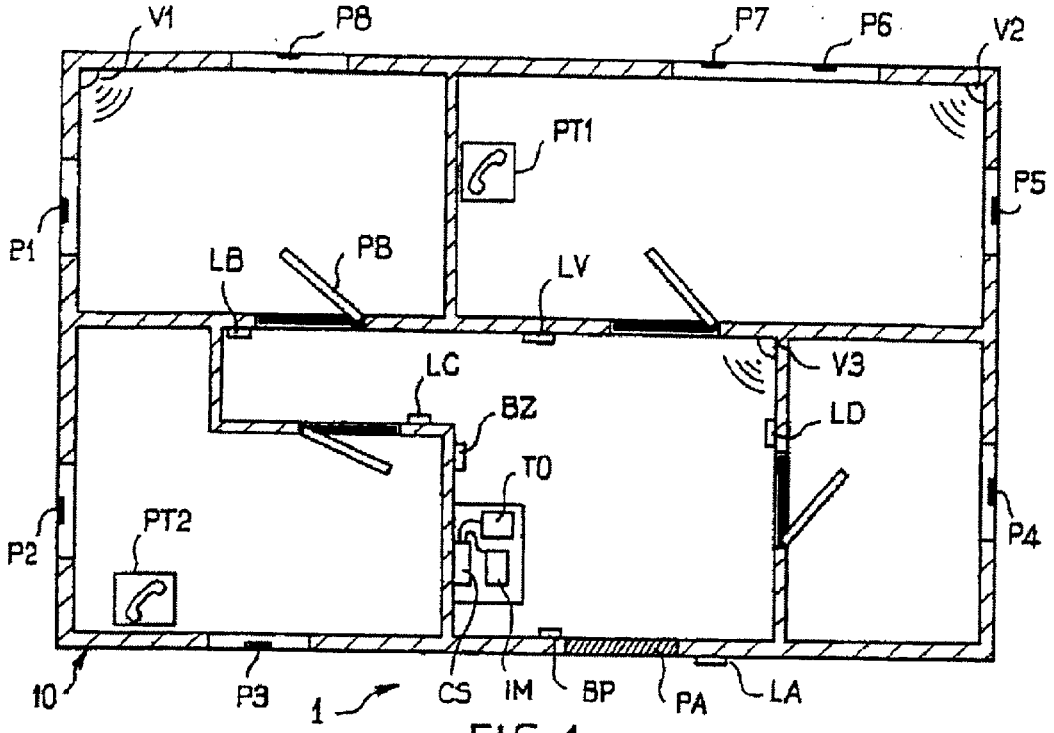
FIG. 1 illustrates an example installation of a surveillance system according to the invention.
Figure 2:
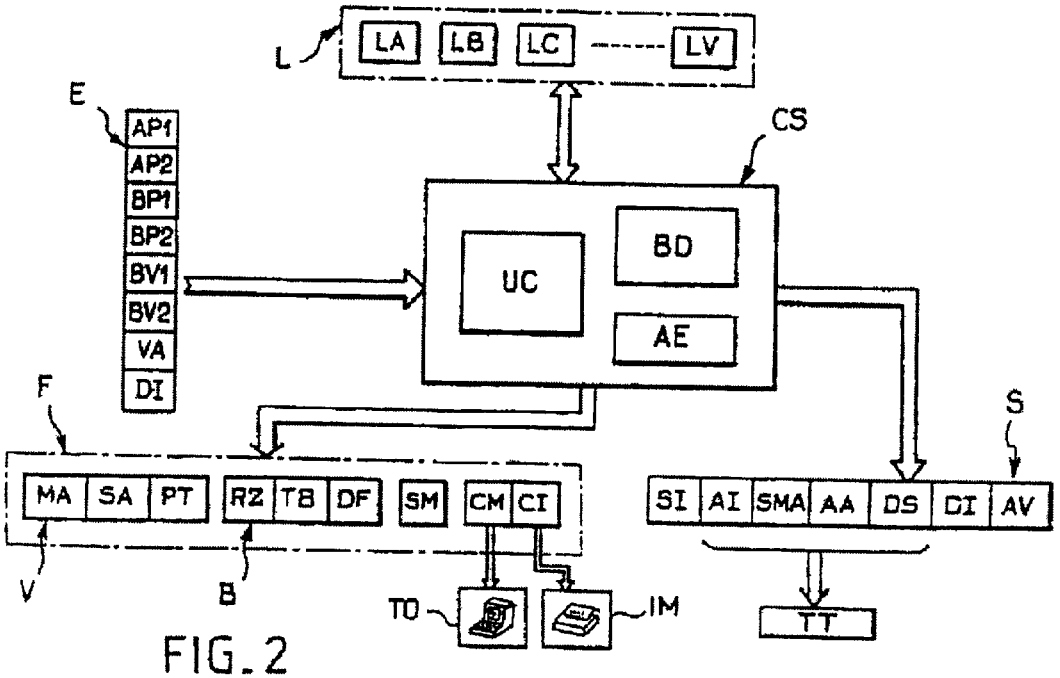
FIG. 2 is a block diagram of a central unit within a surveillance system according to the invention.

The central surveillance unit CS includes, by reference to FIG. 2, a central control and processing unit UC, a memory unit containing a database BD and equipment AE for supplying power from the mains and independently from batteries.

The organisation of all the data and parameters of the surveillance system into a single database allows effective management of the components of the system and faster processing of the surveillance actions and events. The central surveillance unit functions as for industrial automation and each element of the system is referenced in the database according to a standard description of the level-name-attributes type.

The front face F of the cabinet containing the central surveillance unit CS comprises, by way of non-limiting example, outputs including:

a set of lights V, particularly alarm memory-storage and loop test lights MA, an overall alarm lights SA and an access presence lights PT, a set of push buttons B, particularly a push button RZ for re-setting the alarm memories to zero, a loop-test push button TB, and a push button DF for securing the premises with exceptional offsetting of the surveillance period, a lock SM for starting up/shutting down the central surveillance unit CS, a connector CM to a microcomputer or to a Minitel TO, and a connector CI to a serial printer IM.

The inputs E of the central surveillance unit CS include, by way of non-limiting example:

two self-protection inputs AP1, AP2 providing permanent surveillance-outside the programming timetable—of the central surveillance unit, four "perimeter" loops BP1, BP2, grouping together all the detection equipment subject to control by a programming schedule, four "volumetric" loops BV1, BV2 grouping together all the detection equipment subject to automatic postponement action, a validation input VA for allowing validations of presence by means other than the badges, and an immediate-start input DI for securing the premises in a working period.

The outputs S supplied by the central surveillance unit CS comprise:

a siren output SI activated according to a programmable alarm cycle, outputs intended for telephony transmitter TT, particularly:

an intrusion-alarm output AI, an output SMA for starting up/shutting down perimeter surveillance, a self-protection alarm output AA, and a mains-failure output DS, an unoccupied detection output DI, and a validation-call output AV.

By way of practical and non-limiting embodiment example, an electronic card employed in a surveillance system 1 according to the invention may manage up to eight badge readers and ten alarm loops.

Two parameters are sufficient for configuring the automatic routine for putting the alarm function into and out of service:

the time of start and finish of working periods, the duration of derogation.

The essential stages of the surveillance method according to the invention will now be described, by reference to FIGS. 3 and 4. The automatic surveillance of the premises 10 is achieved in two stages which correspond to the two conventional levels of security which are perimeter monitoring and volumetric monitoring.

Figure 3:
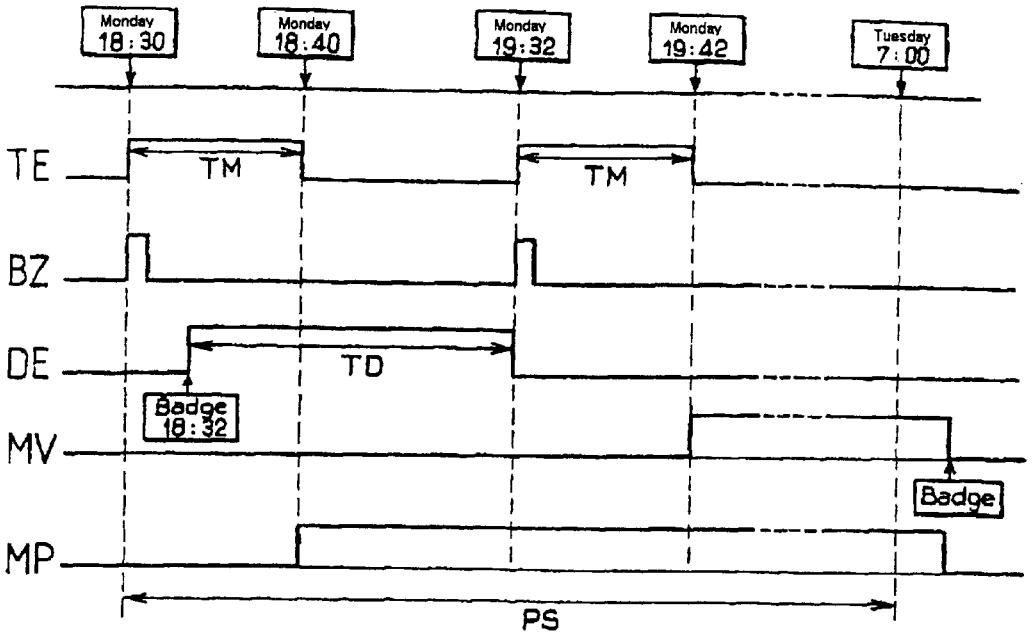
FIG. 3 is a timing diagram illustrating a first characteristic situation handled by the surveillance method according to the invention.

A first stage consists in putting perimeter monitoring MV of the premises 10 into service at the end of the working period, for example on expiry of a time delay TM following the time at which a working period ends, such as 18:30 on Monday evening, as FIG. 3 illustrates.

A second stage consists in ascertaining, before activating the volumetric surveillance, that the premises 10 are empty. To do that, the central surveillance unit CS, at the end of the working period (18:30) causes a buzzer BZ to sound a signal to the persons still present that the monitoring of the premises 10 will be put into service. These persons then have a certain adjustable period TM, for example ten minutes, to leave the building or to signal their presence to the central unit CS. The presence-validation stage can be carried out:

either by badging on the access-control readers LA–LD, or by badging on the validation readers LV provided for this purpose, which may be installed in corridors or common areas.

In the event of nobody signalling his presence, volumetric surveillance is activated.

In the opposite case illustrated in FIG. 3, if a person has badged at 18:32 and if the authorisations allocated to his badge allow him to remain in the building, the securing is postponed for an adjustable period TD, for example one hour.

On conclusion of this period, known as derogation period, the validation-call buzzer is again activated and the call cycle is relaunched. If no presence validation is detected at the end of the time delay TM, volumetric surveillance MV is then activated.

It should be noted that it is at the end of the first validation-call cycle that perimeter surveillance is activated. At the end of the programmed surveillance period, for example at 7:00 in the morning, the perimeter and volumetric surveillance are de-activated only upon the first request for access.

Ending the surveillance of the building is carried out according to the following two modes.

Figure 4:
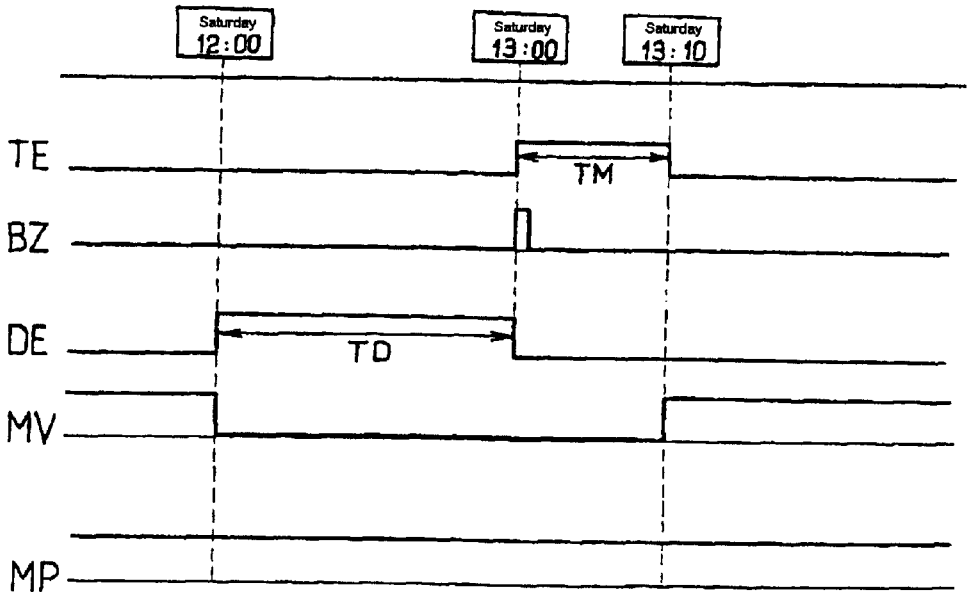
FIG. 4 is a timing diagram illustrating a second characteristic situation dealt with by the surveillance method according to the invention.

Outside working hours, by reference to FIG. 4, volumetric surveillance MV is de-activated when a person badges in order to re-enter the premises, for example on a Saturday at 12:00. Perimeter monitoring MP remains active. At the expiry of the suspension period DE, of a predetermined duration TD, for example one hour, the validation-call buzzer BZ is activated, and the call cycle is relaunched. If the person has left the premises, volumetric surveillance MV is re-activated.

It is important to note that the manager of the surveillance system according to the invention may, depending on requirements, determine, on the one hand, those of the intrusion-detection equipment items which will be the subject of a postponement mechanism ("volumetric surveillance") and, on the other hand, those which will be the subject of a programming timetable ("perimeter surveillance") independently of their actual location within the premises. This option thus allows a person who has to work in the premises during a period of surveillance to be able to open the windows of his office if the perimeter monitoring detectors associated with them have been assigned to the postponement mechanism.

In working hours, the volumetric and perimeter security monitoring are de-activated for the rest of the working period, if and only if an authorised person badges in order to enter the building.

The essential stages of the use of the surveillance system according to the invention will now be described. When a person responsible for the surveillance system wishes to make changes to the programming timetable and to the parameter settings of the control of access, he runs a management and parameter-setting software programme, from the TO terminal (microcomputer or Minitel), or remotely from a remote surveillance site, which is accessible only after having entered a password. This software comprises three main parts:

access to the database comprising a list of badges, the rights of the badges and the timetable, and the calendar of non-working days, access to a journal of accesses and to a journal of events, alteration of the parameters: readers, re-setting the date and time, password management, rejections and settings.

The list of badges comprises, for each badge:

a badge number which is the identifier allowing the surveillance system according to the invention to associate a badge with its holder;

access rights which correspond to the time-based and geographical authorisations of the carrier. The same rights may be associated with several persons;

a validity end date;

an "anti-double-entry" indicator which, when it is activated, means that a person cannot enter a room if he or she has not first of all left this room.

The operator of the surveillance system according to the invention may thus, from this database, create, alter or delete badges.

As far as the programming timetable is concerned, it is possible to programme a time window during which the door-opening command is continuous and access is therefore free. This corresponds to the period called working hours. It is, obviously, possible to define the non-working days which the surveillance system will have to take into account.

The accesses journal records all the access-request and presence-validation operations accepted on the readers of the surveillance system according to the invention. These operations may be consulted at any time in the accesses journal.

The events journal, which can be consulted at any time, records the following events:

access and validation requests refused, with the reason for refusal, the operations carried out on the central surveillance unit with the user's number, the events or alarms relating to the intrusion-detection equipment, such as the forcing of a door, a door open for too long a time or a loop giving an alarm.

The parameter setting of the surveillance system according to the invention makes it possible particularly to configure each reader linked to the system and to determine the time delays and the working and surveillance periods. Different types of readers may be employed in a surveillance system according to the invention, particularly:

simple readers for control of access to a door, air lock management readers, in which access is controlled for entry and exit is free by push button.

Some readers employed in the surveillance system according to the invention have no access-control function but are dedicated solely to the presence-validation function. It is also possible to use a reader controlling access to an area under volumetric surveillance. When a request for access is made and validated on this reader, not only should the door open but the system should also inhibit volumetric protection.

Parameters associated with the readers may be altered by the operator of the surveillance system according to the invention. For example, it is possible to provide for detection of a door which is stuck open or for systematic re-locking of the bolt of a door in the event that a person has badged or pressed on the push button without passing through the access. Many other special or supplementary functions may be envisaged, such as the use of a ground loop or of a radar in place of a push button, immediate forcing of opening, a call for remote service.

It is also possible to define, on the central surveillance unit, the contact polarities of each input and of each output of the central unit.

The function of rejecting a faulty loop makes it possible, in the event of a permanent fault on an alarm loop (detectors broken, cable cut), to provide surveillance of the other loops while neutralising or rejecting the faulty loop. The rejection of a loop means that the central unit is requested to take no account of this faulty loop. The various loops of a surveillance system according to the invention may be rejected, whether they are perimeter or volumetric loops or self-protection loops, as can their reader, independently.

The timetable allows automatic management of the surveillance. The following may particularly be defined:

the start of the time slot corresponding to the time when the majority of personnel arrive, which does not entail immediate stopping of surveillance, and the end of the time slot, which launches the validation-call cycle to delay the start of volumetric surveillance.

It should be noted that if there is no defined timetable, the central unit is put into surveillance mode by action on the "immediate start" push button and out of surveillance mode by an accepted validation or by the closing of the "presence validation" input contact.

Different time delays may be set up:

the duration of the suspensions or postponements, the duration of the pre-call, which sets the duration of operation of the buzzer or of the ringing, the time after the pre-call before the end of the suspension, which sets the duration between the end of the validation call and the actual entry into service of the surveillance, the siren alarm duration, during which the siren will operate in the event of an intrusion alarm, and the time delay between two triggerings of the siren in the event of an intrusion alarm.

Obviously, the invention is not limited to the examples which have just been described, and numerous rearrangements can be applied to these examples without departing from the scope of the invention. Thus, the intrusion-detection equipment and the access-control equipment may be of any type. The central surveillance unit may be of a different structure to that which has just been described and particularly be linked to remote surveillance and remote maintenance systems.

What is claimed is:

1. System (1) for surveillance of premises (10), comprising:

means for controlling access to these premises (10), comprising personal identification means, means (LA–LE) for reading these personal identification means and means (CS) for processing and granting requests for access to said premises (10), means for detecting any intrusion or unauthorised presence in said premises (10), comprising perimeter detection means (P1–P8) for detecting any intrusion into a defined perimeter around said premises (10), volumetric detection means (V1–V3) for detecting any presence in predetermined areas of said premises, this system (1) further including a programming timetable defining working periods and surveillance periods corresponding to the intrusion detection means being put into service, characterised in that the access-control means and the intrusion-detection means co-operate to postpone the activation of volumetric detection means (V1–V3) by a predetermined derogation period (TD) whenever the said access-control means, during periods when surveillance is in force, validate the presence of, or a request for access from, an authorised person provided with personal identification means, characterized in that the means of perimeter detection (P1 to P8) are kept active during the postponements of activation of the volumetric detection means (V1–V3).

2. System (1) according to claim 1, characterised in that the access-control means and the intrusion-detection means co-operate so as also to postpone the activation of certain predetermined perimeter detection means, in the same way as the postponed volumetric detection means.

3. System (1) according to claim 1, characterised in that the access-control means and the intrusion-detection means co-operate so as to keep certain predetermined volume-detection means activated during the surveillance periods, in the same way as the perimeter-detection means activated according to the programming timetable.

4. System (1) according to claim 1, characterised in that the access-control means and the intrusion-detection means co-operate so as, in working hours, not to de-activate the volumetric detection means (V1–V3) and the perimeter detection means (P1–P8) for the rest of the working period, until after validation of a first request for access by an authorised person.

5. System (1) according to claim 1, characterised in that it further comprises means (BZ, PT1–2) for inviting any person present in the premises (10) during the periods of surveillance to validate his presence in the said premises (10).

6. System (1) according to claim 5, characterised in that access-control reading means (LA–LE) are configured to receive a validation of presence by a person in response to a call by the invitation means (BZ, PT).

7. System (1) according to one of claim 5, characterised in that the access-control means co-operate with the internal communications means (PT) of said premises (10) in order to invite any person present in the premises to validate his presence and to receive presence validations.

8. System (1) according to claim 5, characterised in that it further comprises specific means (LV) for receiving a validation of presence by a person in response to call by the invitation means (BZ, PT).

9. System (1) according to claim 1, characterised in that it further comprises central surveillance means (CS) connected to the intrusion-detection means and to the access-control means and comprising means for setting the parameters of said intrusion-detection means and access-control means.

10. System (1) according to claim 9, characterised in that the central surveillance means (CS) further comprise a database (BD) containing access rights and time-based management parameters.

11. System (1) according to claim 1, characterised in that it further comprises means for receiving an order for immediate activation of the intrusion-detection means.

12. Method for surveillance of premises, implemented in the system (1) according to claim 1, characterised in that it comprises, at an instant defined as being the end of a working period, a stage of activation of the perimeter detection means (P1–P8), characterized in that it further comprises a stage for inviting any person present in the premises (10) to have his presence validated by presenting personnal identification means to means (LA–LE) for reading these personal identification means, this invitation stage being followed: (i) in the event of non-validation of presence, by activation of the volumetric detection means (V1–V3), (ii) in the event of a validation of presence, by a postponement of activation of the volumetric detection means (V1–V3) by a predetermined derogation period (TD).

13. Method according to claim 12, characterised in that it further comprises, for each working period, a stage of de-activation of the perimeter detection means (P1–P8) and of the volumetric detection means (V1–V3) for the rest of the working period, this de-activation stage being carried out only after the first validation of a request for access by an authorised person.

14. Method according to claim 12, characterized in that it further comprises, in a working period or during a sequence of derogation of a surveillance period, a stage for immediately activating the intrusion-detection means in response to an immediate activation command.

15. Method according to claim 12, characterised in that the invitation stage comprises the activation of a buzzer (BZ) for a predetermined invitation duration.

* * * * *

UNITED STATES PATENT AND TRADEMARK OFFICE

CERTIFICATE OF CORRECTION

PATENT NO. : 6,111,502
DATED : August 29, 2000
INVENTOR(S) : Pascal Lenglart et al.

It is certified that error appears in the above-identified patent and that said Letters Patent is hereby corrected as shown below:

Title page,
Amend item [22] to read as follows:

-- [22] PCT Filed: March 18, 1998. --.

Signed and Sealed this

Twenty-third Day of April, 2002

*Attest:*

*Attesting Officer*

JAMES E. ROGAN
*Director of the United States Patent and Trademark Office*